US005311622A

United States Patent [19]

Allen

[11] Patent Number: 5,311,622

[45] Date of Patent: May 17, 1994

[54] PATIENT HANDLING DEVICE

[76] Inventor: Roy H. Allen, 265 North 110th St., Wauwatosa, Wis. 53226

[21] Appl. No.: 909,148

[22] Filed: Jul. 6, 1992

[51] Int. Cl.[5] ..... A61G 7/10

[52] U.S. Cl. ..... 5/81.1; 108/142

[58] Field of Search ..... 5/507.1, 81.1; 108/139, 108/142

[56] References Cited

U.S. PATENT DOCUMENTS

| | | | |
|---|---|---|---|
| 898,228 | 9/1908 | Kunkle | 108/142 |
| 1,844,664 | 2/1932 | Larson | 108/142 |
| 2,757,388 | 8/1956 | Chisholm | 5/507.1 |
| 2,963,713 | 12/1960 | Forrest | 5/507.1 |
| 3,911,509 | 10/1975 | Fleckenstein | 5/507.1 |
| 4,086,859 | 5/1978 | Donder | 108/142 |
| 4,279,043 | 7/1981 | Saunders | 5/81.1 |
| 4,829,612 | 5/1989 | Adams | 5/81.1 |
| 4,934,003 | 6/1990 | Hayakawa | 5/81.1 |
| 5,054,137 | 10/1991 | Christensen | 5/81.1 |
| 5,079,789 | 6/1992 | Tandrakovic | 5/81.1 |

*Primary Examiner*—Peter M. Cuomo
*Assistant Examiner*—Flemming Saether
*Attorney, Agent, or Firm*—Michael, Best & Friedrich

[57] ABSTRACT

A device for facilitating the transfer of an incapacitated individual from a bed to a wheelchair includes a foot support having a generally planar upper surface for receiving the patient's feet and a base disposed vertically below the foot support and having a generally planar lower surface for engaging a support floor, coupling means for rotatably coupling the foot support on the base for relative rotation about a generally vertical axis and with the upper surface of the foot support and the lower surface of the base lying in generally parallel horizontal planes.

2 Claims, 1 Drawing Sheet

PATIENT HANDLING DEVICE

BACKGROUND OF THE INVENTION

This invention relates to patient handling devices and more particularly to a device for facilitating the transfer of an incapacitated individual from a bed to a wheelchair.

Medical personnel have experience substantial difficulty in transferring incapacitated patients from a bed to a wheelchair. While such patients can be raised to a standing position with his or her back to the bed, it was then necessary to reorient the individual so that he or she could be seated in a wheelchair adjacent the bed. Difficulty arises where the patient is relatively large and cannot move his or her feet as a result of a crippling illness or injury.

SUMMARY OF THE INVENTION

It is an object of the invention to provide a new and improved patient handling device.

Another object of the invention is to provide a patient handling device which facilitates the transfer of an incapacitated individual from a bed to a wheelchair.

A further object of the invention is to provide a patient handling device having a foot support portion wherein the patient can be reoriented without moving the patient's feet relative to the foot support.

These and other objects and advantages of the present invention will become more apparent from the detailed description thereof taken with the accompanying drawings.

In general terms, the invention comprises a device for facilitating the transfer of an incapacitated individual from a bed to a wheelchair and including a foot support means having a generally planar upper surface for receiving the patient's feet, a base disposed vertically below the foot support means and having a generally planar lower surface for engaging a support floor, coupling means for rotatably coupling the foot support means to the base for relative rotation about a generally vertical axis and with the upper surface of the foot support means and the lower surface of the base lying in generally parallel horizontal planes so that the feet of an individual may be placed on the foot support means while the individual is seated on a bed and permitting the individuals upper body to be lifted from the bed and the foot support means then rotated to reposition the individual to permit the individual being seated in a wheelchair disposed adjacent the bed.

DETAILED DESCRIPTION OF THE PREFERRED EMBODIMENT

Figure 3:
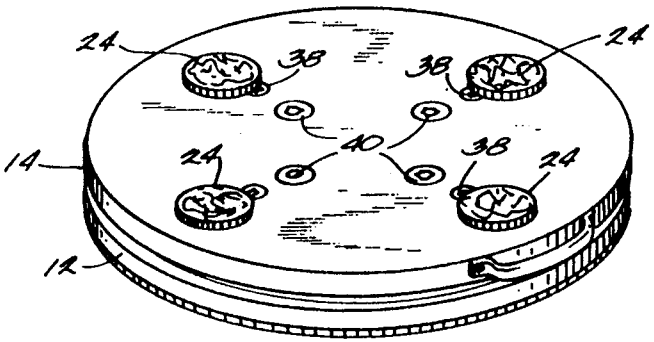
FIG. 3 is a bottom perspective view thereof.
Figure 2:
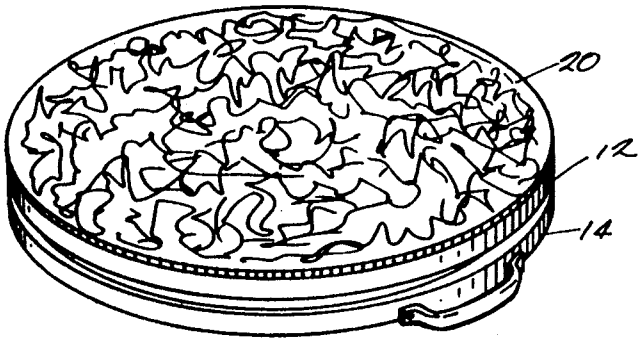
FIG. 2 is a top perspective view thereof.
Figure 1:
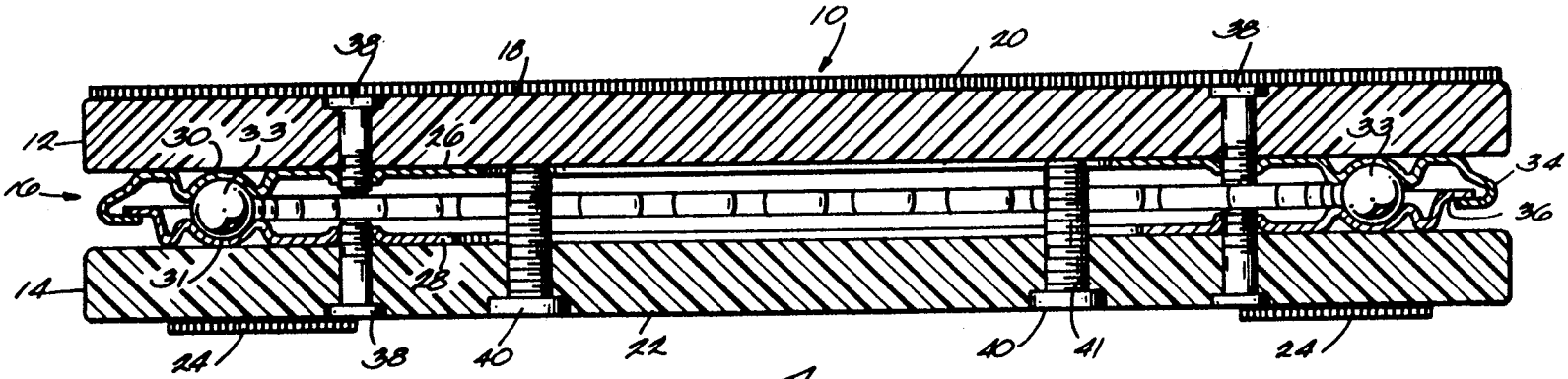
FIG. 1 is a side elevational view of the patient transfer device according to the preferred embodiment of the invention.

The patient transfer device 10 according to the preferred embodiment of the invention is shown in the drawing to include a disc-shaped upper plate 12, a disc-shaped lower plate 14 and a rotary coupler 16 disposed therebetween. The upper and lower plates 12 and 14 may be formed of any suitable materials, such as polyurethane. The upper surface 18 of the top plate 12 lies in a generally horizontal plane and may be covered by a fabric pad or carpeting 20. The surface 18 and the pad 20 define a patient foot support. The lower surface 22 of the bottom plate 14 also lies in a horizontal plane for engaging a support floor. A plurality of rubber or rubber-like pads 24 may be fixed to the lower surface 22 to prevent the transfer device 10 from sliding.

The rotary coupler 16 includes an annular top plate 26 and an annular bottom plate 28, both formed of a suitable metallic material. The plates 26 and 28 each, respectively, are formed with an annular groove 30 and 31, which define a race for ball bearings 33. In addition, the plate 26 has an outer lip 34 which passes around and under the rim 36 of the plate 28 to prevent the plates from separating. The upper plate 12 and the lower plate 14 are secured to the coupler 16 in any suitable manner, such as by means of screws 38, which pass through the upper and lower plates 12 and 14 and are received in threaded openings formed in the top and bottom plates 26 and 28 of coupler 16. In addition, a plurality of nylon screws 40 are secured in threaded openings 41 in the lower plate 14 and their ends bear against the under surface of the upper plate 12 to retard relative rotation of the plates 12 and 14. A handle 43 may be secured to one of the members 12 or 14 to facilitate handling of the device 10.

In operation, the patient transfer device 10 is positioned adjacent the patient's bed so that the patient may be seated at the side of the bed with his or her feet engaging the pad 20 on the upper surface 18. The patient may then be elevated to a standing position and the upper plate 12 then rotated through an angle sufficient to orient the patient so that his or her back is adjacent a wheelchair facing the transfer device 10. It is thus possible to move the patient from a bed to a wheelchair without requiring movement of the patient's feet, which may be difficult in the case of a large patient who is incapable of self-movement.

While only a single embodiment of the invention has bee illustrated and described, it is not intended to be limited thereby, but only by the scope of the appended claims.

I claim:

1. A device for facilitating the transfer of an incapacitated individual from a bed to a wheelchair and including a foot support means having a generally planar upper surface for receiving the patient's feet, a base disposed vertically below said foot support means and having a generally planar lower surface for engaging a support floor, coupling means for rotatably coupling the foot support means to said base for relative rotational movement about a generally vertical axis and with the upper surface of the foot support means and the lower surface of the base lying in generally parallel horizontal planes so that the feet of an individual may be placed on the foot support means while the individual is seated on the side of a bed and permitting the individual's upper body to be lifted from the bed and the foot support means rotated to reposition the individual in a position for being seated in a wheelchair adjacent the bed, means disposed on the lower surface of the base to inhibit sliding, said foot support means and the base comprising first and second disc-like members, respectively, disposed in a parallel, side-by-side manner, said coupling means including a first member secured to said first disc-like member and a second member secured to the second disc-like member and bearing means disposed between said first and second members to facilitate rotational movement therebetween, and adjustable means mounted on one of said disc-like members and frictionally engageable with the other disc-like member for retarding relative rotational velocity between said upper and lower disc-like members, wherein said adjustable means extend and move along a generally vertical axis and includes means threadably received in one of said disc-like members and having an end portion movable into frictional engagement with the other disc-like member for retarding the relative rotational movement between said disc-like members to minimize the possibility that an incapacitated person on the foot support will be thrown off when the foot support is rotated.

2. The device set forth in claim 1 wherein said threaded means comprises a plurality of screws threaded into said base in a spaced apart relation and having ends which engage the foot rest, said screws being formed of a non-metallic material, the pressure between said screws and the footrest being adjustable by rotating said screws toward and away from the footrest.

* * * * *